United States Patent [19]

Ikeda et al.

[11] 4,353,543

[45] Oct. 12, 1982

[54] SORTER CONNECTION APPARATUS

[75] Inventors: Sunao Ikeda, Yokohama; Tamaki Kaneko, Fujisawa; Kunio Hibi, Yokohama; Tugio Okuzawa, Tokyo; Yohtaro Kakitani; Hideo Kikuchi, both of Yokohama, all of Japan

[73] Assignee: Ricoh Co., Ltd., Japan

[21] Appl. No.: 188,945

[22] Filed: Sep. 19, 1980

[30] Foreign Application Priority Data

Sep. 28, 1979 [JP] Japan ..... 54-134392

[51] Int. Cl.[3] ..... B65H 29/54

[52] U.S. Cl. ..... 271/306; 271/273

[58] Field of Search ..... 271/273, 274, 306; 226/89, 90

[56] References Cited

U.S. PATENT DOCUMENTS 2,162,706 6/1939 Dodds ..... 226/89
3,072,397 1/1963 Kelchner ..... 271/274 X
3,218,064 11/1965 Davidson ..... 271/273
4,124,204 11/1978 Van Buskirk ..... 271/273 X

*Primary Examiner*—Richard A. Schacher
*Attorney, Agent, or Firm*—McGlew and Tuttle

[57] ABSTRACT

A sorter connection apparatus disposed between a copying machine and a sorter, which is capable of feeding individually copy sheets discharged from the copying machine into the sorter, comprising a lower guide plate connecting the sheet outlet of the copying machine to the sheet inlet of the sorter, an upper guide plate situated above the lower guide plate, mounted detachably on the lower guide plate through a detachment device, and a sheet transportation roller which is in contact with the lower surface of the upper guide plate and at least the outer peripheral portion of which is made of an elastic material which can be easily deformed under application of pressure thereto. The sheets are transported, while held between the upper guide plate and the sheet transportation roller.

4 Claims, 4 Drawing Figures

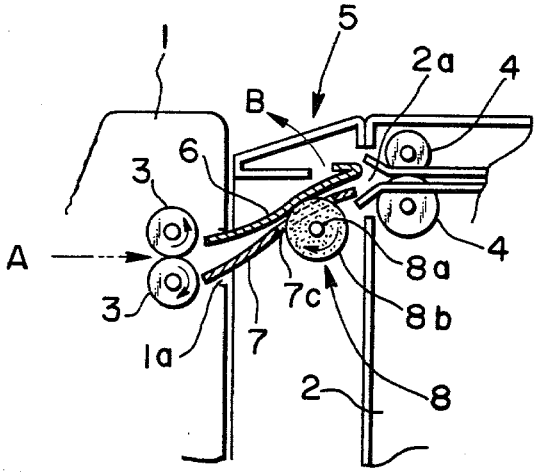
FIG.1
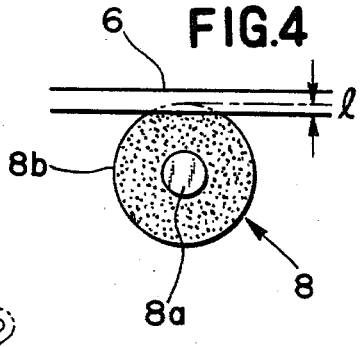
FIG.4
FIG.3
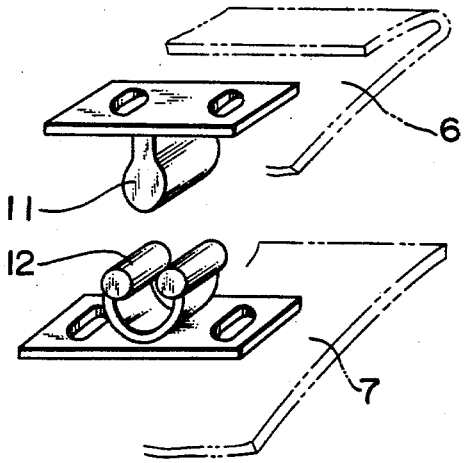

SORTER CONNECTION APPARATUS

BACKGROUND OF THE INVENTION

The present invention relates to a sorter connection apparatus for connecting a copying machine to a sorter, for feeding copying sheets discharged from the copying machine into the sorter.

Conventionally, when the sheet discharge outlet of a copying machine is positioned at a different level from that of the sheet inlet of a sorter and accordingly sheets cannot be directly fed into the sorter from the copying machine, a connection apparatus attached to the sorter, capable of feeding sheets into the sorter from the copying machine, is employed.

A conventional sorter connection apparatus of the above-mentioned type is disclosed in Japanese laid-open patent application Ser. No. 53-33724. The sorter connection apparatus is provided with a bridge portion comprising pulleys and sheet transportation belts. That sorter connection apparatus, however, has shortcomings, such as being over-sized and complex in mechanism. Moreover, jammed sheets cannot always be removed safely if it is done when the sheet transfer belts are driven.

SUMMARY OF THE INVENTION

It is therefore an object of the present invention to provide a sorter connection apparatus for a sorter, which is simple in mechanism and inexpensive, which guarantees safe and simple removal of jammed sheets, and from which the drawbacks in the prior-art sorter connection apparatus have been successfully eliminated.

According to the present invention, the above-mentioned object has been attained by constructing the sorter connection apparatus in such a manner that an upper guide plate and a lower guide plate, which extend from the sheet discharge outlet of a copying machine to the inlet of a sorter, are provided, and a signle sheet transportation roller which is made of an elastic material is disposed in contact with the lower surface of the upper guide plate and copy sheets are individually transported, while being held between the upper guide plate and the sheet transportation roller.

This and other objects of the present invention will become apparent from the following description of an embodiment thereof when taken together with the drawings.

BRIEF DESCRIPTION OF THE DRAWINGS

In the drawings;

FIG. 1 is a schematic cross-sectional view of an embodiment of a sorter connection apparatus according to the present invention;

FIG. 3 is a partial enlarged view of the engagement portion between an upper guide plate and a lower guide plate in the embodiment in FIG. 1; and FIG. 4 is a schematic cross-sectional view of the connecting portion between a sheet transportation roller and the upper guide plate in the embodiment in FIG. 1.

DETAILED DESCRIPTION OF THE PREFERRED EMBODIMENT

Figure 2:
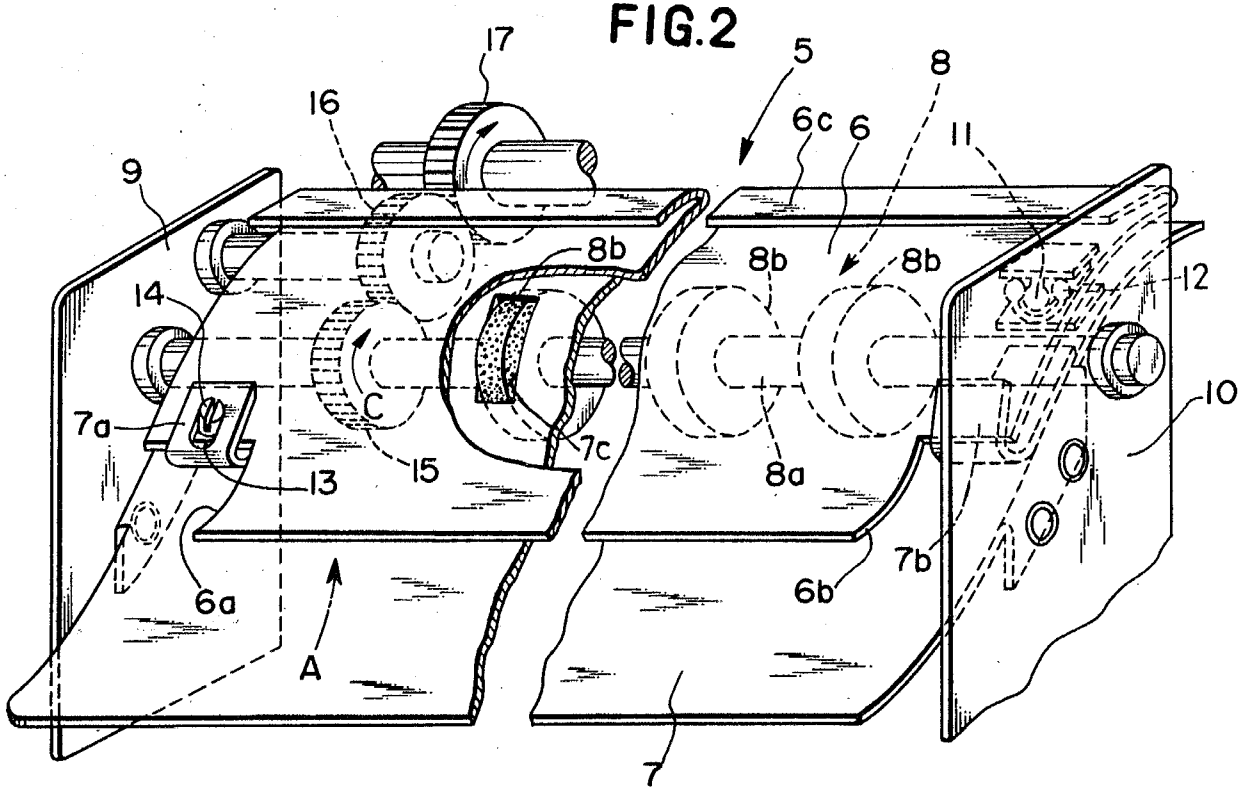
FIG. 2 is a perspective view of the embodiment of the sorter connection apparatus in FIG. 1.

Referring to FIG. 1, there is shown a schematic cross-sectional view of an embodiment of a sorter connection apparatus according to the present invention. In the figure, reference numeral 1 represents a copying machine. Reference numeral 2 represents a sorter apparatus which is disposed adjacent to the copying machine 1. Reference numeral 3 represents a pair of sheet discharge rollers for discharging sheets, which are disposed in the copying machine 1. Reference numeral 4 represents a pair of sheet feed rollers disposed in the sorter 2, for feeding sheets individually into the sorter 2.

Copy sheets discharged from the copying machine 1 are discharged individually therefrom by the sheet discharge rollers 3, which are rotated in the directions of the respective arrows. The discharged sheets are individually fed into the sorter 2 via a sorter connection apparatus 5, so that the sheets are collated or sorted. In FIG. 1, the sheet transportation direction in the copying machine 1 is represented by arrow A.

The sorter connection apparatus 5 comprises an upper guide plate 6, a lower guide plate 7 and a sheet transportation roller 8 which will be described in detail later. The inlet portions of the pair of guide plates 6 and 7 are inserted into a sheet discharge outlet 1*a* of the copying machine 1, while the outlet portions of the guide plates 6 and 7 reach an inlet portion 2*a* of the sorter 2. The lower guide plate 7 is fixed to two side walls 9 and 10 attached to the sorter 2. On the lower guide plate 7, the upper guide plate 6 is mounted detachably by a detachment device disposed at the side of the side wall 10 as shown in FIG. 3. The detachment device comprises an engagement projection 11 which is fixed to one side portion of the inner surface of the upper guide plate 6, and a catching member 12 which is fixed to the inner surface of the lower guide plate 7, right under the engagement projection 11 like a snap-fastener.

Referring to FIG. 2, in the opposite lower end portions of the upper guide plate 6, there are formed notches 6*a* and 6*b*. Under the notches 6*a* and 6*b*, V-shaped fixing members are fixed to the inner surface of the lower guide plate 7 in such a manner one bent portion of each of the V-shaped fixing members is fixed to the lower guide member 7, while their other bent portions 7*a*, 7*b*, come above the upper guide plate 6, so that the lower edges of the notches 6*a* and 6*b* are loosely fitted into the V-shaped fixing members.

In the bent portion 7*a* of the V-shaped fixing member fixed to the lower guide plate 7, on side of the side plate 9, in the diagonal direction with respect to the catching member 12, there is formed a slot 13 in the copy sheet transport direction A. Into the slot 13, there is fitted a pin 14 which is secured near the lower edge of the notch 6*a*. When the engagement projection 11 is disengaged from the catching member 12, the upper guide plate 6 can be turned approximately about the lower edges of the notches 6*a* and 6*b* in the direction of arrow B shown in FIG. 1. Such turning of the upper guide plate 6 is permitted since the slot 13, in which the pin 14 is fitted, is formed long in the same direction as the turning direction of the upper guide plate 6. The upper guide plate 6 can be fixed to the lower guide plate 7, by engaging the engagement projection 11 with the catching member 12, while fitting the pin 14 into the slot 13. A holding portion 6*c* is attached to the upper edge portion of the upper guide plate 6 for easy detachement thereof from the lower guide plate 7.

A shaft 8*a* is rotatably supported by the side walls 9 and 10. On the shaft 8*a*, a sheet transportation roller 8 is mounted and at least its peripheral surface is made of an elastic material, for instance, an elastic foam material. In this embodiment, the sheet transportation roller 8 consists of a plurality of roller members 8*b*, which are fixed to the shaft 8*a*. The roller members 8*b* are made of an elastic material. The sheet transportation roller 8 can be rotated by either a drive apparatus of the copying machine or a drive apparatus of the sorter via a drive transmission device. In this embodiment, the sheet transportation roller 8 is rotated by a drive apparatus (not shown) of the sorter. The drive transmission device for this embodiment comprises a connection drive gear 15 fixed to the rotating shaft 8*a* for the sheet transportation roller 8, an intermediate gear 16, and a drive gear 17, which are connected to the aforementioned apparatus. The drive gear 17 is, for example, fixed to the drive roller shaft of the sheet feed roller pair 4. When the drive gear 17 is rotated in the direction of the arrow, the connection drive gear 15 is rotated by the intermediate gear 16, whereby the sheet transportation roller 8 is rotated in the direction of arrow C.

The rotating shaft 8*a* of the sheet transportation roller 8 is disposed under the lower guide plate 7 and part of the peripheral surface of each roller member 8*b* passes through an opening 7*c* formed in the lower guide plate 7 (refer to FIG. 1) and is in contact with the inner surface of the upper guide plate 6 with a predetermined pressure. Since each roller member 8*b* is in pressure contact with the inner surface of the upper guide plate 6, with elastic deformation, the contact area of the copy sheet with the roller member 8*b* is large and therefore the copy sheet can be transported reliably. The drive device for the connection drive gear 15 and the other gears is disposed under the lower guide plate 7.

In the sorter connection 5, the copy sheets are individually discharged from the copying machine, while being held between the sheet discharge roller pair 3, and fed between the guide plate 6 and the guide plate 7 in the direction of the arrow A. The copy sheet individually held between the upper guide plate 6 and the sheet transportation roller 8 and fed into the sorter, while being held between the sheet feed roller pair 4, so that the sheets are collated or sorted. Thus, the sorter connection apparatus 5 is operated, connecting the copying machine and the sorter. When sheet jamming takes place within the sorter connection apparatus 5, since the upper guide plate 6 is detachably mounted on the lower guide plate 7, the upper guide plate 6 can be detached from the lower guide plate 7 by turning the upper guide plate 6 in the direction of the arrow B by holding the holding portion 6*c*, thereby the engagement projection 11 being disengaged from the catching member 12. Thus, the jammed sheet can be removed without any difficulty. Furthermore, if the jammed sheet is removed, when the sheet transportation roller 8 is in rotation, there will be no danger, since the gears for driving the sheet transportation roller 8 are disposed under the lower guide plate 7. Further, if the operator happens to touch the roller members 8*b*, there will be no danger since the roller members 8 are made of an elastic foam material and deforms easily when touched.

In the present invention, since a single sheet transportation roller comprising a plurality of roller members is employed, the sorter connection apparatus is simple in mechanism and compact in size and inexpensive.

In the sorter connection apparatus shown in FIG. 1, the sheet transportation roller 8 was experimentally made of an elastic material, and the distance l between the contact surface of the upper guide plate 6 and an imaginary peripheral surface of each roller member 8*b*, on the assumption that there is no upper guide plate 6, was adjusted so as to be in the range of 1 to 2 mm by bringing each roller member in pressure contact with the upper guide plate 6, as shown in FIG. 4. This allowed roller 8 to slip if a sheet was stopped at its downstream end to stop sheet feed motion. The results showed that sheets were transported successfully.

What is claimed is:

1. In a sorter connection apparatus disposed between a copying machine and a sorter for individually feeding copy sheets discharged from the copying machine into the sorter, the improvement comprising a lower guide plate connected to a sheet discharge outlet of said copying machine at its inlet side and to an inlet portion of said sorter at its outlet side, an upper guide plate located above said lower guide plate and detachably mounted to said lower guide plate through a hook member fixed to a top side of said lower guide plate near an upstream end of said upper guide plate along the copy sheet transport direction and engage-disengage means fixed to said lower guide plate top side near a downstream end of said upper guide plate, a sheet transportation roller made of an elastic foam material provided around at least its peripheral surface and abutted against said upper guide plate with some amount of deformation that is enough to feed the copy sheet with rotation of said roller during normal operation, but to cause said roller to slip with respect to the copy sheet without advancing or crumpling the sheet when the copy sheet is subjected to braking action at the forward downstream end thereof while said roller rotates for feeding the copy sheets and drive means for rotating said roller.

2. A sorter connection apparatus as claimed in claim 1, wherein said drive means includes a sheet transportation shaft disposed under said lower guide plate and carrying said roller, said lower plate having an opening therethrough with part of the peripheral surface of said sheet transportation roller passing through said opening and in contact with a lower surface of said upper guide plate.

3. A sorter connection apparatus as claimed in claim 1, wherein said engage-disengage means comprising an engagement projection fixed to one of said guide plates and a catching member with which said engagement projection can detachably engage, said catching member fixed to the other guide plate.

4. A sorter connection apparatus as claimed in claim 3, wherein said lower guide plate includes a pair of hooked members each having a V-shape and disposed at opposite edges of said lower plate top side with respect to the copy sheet transport direction, each V-shaped hook member positioned at an intermediate location along the copy sheet transport direction, said upper plate having a notch at each opposite edge thereof with respect to the copy sheet transport direction for receiving each V-shaped hook member respectively, said engage-disengage means positioned at one edge of said upper and lower plate, said upper plate including at an opposite edge thereof a pin projection extending upwardly therefrom, the respective one of said V-shaped hook members engaged with the notch of said upper plate at said opposite edge having an elongated slot therein for receiving said pin projection, said elongated slot elongated in the copy sheet transport direction whereby said upper plate can be disengaged from said lower plate at said engage-disengage means and pivoted about said V-shaped hook member to expose the outlet side of said sorter connection apparatus.

* * * * *